US006513607B2

(12) United States Patent
Peterson et al.

(10) Patent No.: US 6,513,607 B2
(45) Date of Patent: Feb. 4, 2003

(54) METAL-FACE-SEAL ROCK BIT

(75) Inventors: Gregory W. Peterson, Arlington, TX (US); Howard J. Walk, Arlington, TX (US)

(73) Assignee: Baker Hughes Incorporated, Houston, TX (US)

( * ) Notice: Subject to any disclaimer, the term of this patent is extended or adjusted under 35 U.S.C. 154(b) by 2 days.

(21) Appl. No.: 09/784,588

(22) Filed: Feb. 15, 2001

(65) Prior Publication Data

US 2002/0108788 A1 Aug. 15, 2002

(51) Int. Cl.[7] ..... E21B 10/22
(52) U.S. Cl. ..... 175/371; 175/337
(58) Field of Search ..... 175/371, 372, 175/337, 331; 384/94; 277/336, 382, 390, 396

(56) References Cited

U.S. PATENT DOCUMENTS

| | | | | |
|---|---|---|---|---|
| 3,397,923 A | | 8/1968 | Galle | |
| 3,861,765 A | | 1/1975 | Follert et al. | |
| 4,176,848 A | | 12/1979 | Lafuze | |
| 4,466,622 A | | 8/1984 | Deane et al. | |
| 4,666,001 A | * | 5/1987 | Burr | 175/371 |
| 4,747,604 A | | 5/1988 | Nakamura | |
| 4,753,304 A | * | 6/1988 | Kelly, Jr. | 175/371 |
| 4,822,057 A | | 4/1989 | Chia et al. | |
| 4,824,123 A | | 4/1989 | Chia et al. | |
| 4,838,365 A | | 6/1989 | Kotch | |
| 4,903,786 A | * | 2/1990 | Welsh | 175/367 |
| 5,040,624 A | | 8/1991 | Schumacher et al. | |
| 5,080,183 A | | 1/1992 | Schumacher et al. | |
| 5,360,076 A | * | 11/1994 | Kelly, Jr. et al. | 175/371 |
| 5,362,073 A | * | 11/1994 | Upton et al. | 277/92 |
| 5,875,861 A | | 3/1999 | Daly et al. | |
| 6,026,917 A | * | 2/2000 | Zahradnik et al. | 175/371 |
| 6,109,376 A | | 8/2000 | Pearce | |
| 6,142,249 A | | 11/2000 | Zahradnik et al. | |
| 6,176,330 B1 | * | 1/2001 | Burr | 175/371 |

FOREIGN PATENT DOCUMENTS

| | | |
|---|---|---|
| EP | 0919691 | 6/1999 |
| EP | 1013876 | 6/2000 |
| GB | 2332461 | 6/1999 |

* cited by examiner

*Primary Examiner*—Frank S. Tsay
(74) *Attorney, Agent, or Firm*—Bracewell & Patterson, L.L.P.

(57) ABSTRACT

A bit is provided having at least one leg extending downwardly and inwardly from the bit body. A cutter cone is rotatably mounted on a shaft extending inwardly from the lower portion of each leg. The annular space defined by the base of the shaft and the inner surface at the base of the cone forms a seal gland. An elastomeric o-ring sealingly engages an inner surface of the cone and a first rigid ring which rotates with the o-ring and cone. The o-ring energizes the first rigid ring for sealingly engaging a second rigid ring mounted to the leg of the bit near the base of the shaft. The second rigid ring is secured to and seals against a surface at the base of the shaft and is held stationary relative to the surface. A lubricant passage for lubricating the seal is pressurized by the drilling fluid pressure in the center of the bit body.

17 Claims, 2 Drawing Sheets

METAL-FACE-SEAL ROCK BIT

BACKGROUND OF THE INVENTION

1. Field of the Invention

The present invention relates in general to earth-boring bits, particularly to those having rotatable cutters in which seal assemblies retain lubricant within the bearing areas.

2. Background Information

One of the most successful seal means used in earth-boring bits of the type having rotatable cutters is the O-ring seal disclosed in commonly assigned U.S. Pat. No. 3,397,928, to Galle. The o-ring seal successfully confines lubricant to the bearing area while excluding detritus for long periods of time before failure.

A more recent seal development is the rigid or metal face seal. In the rigid face seal type, the seal interface is between one or two rigid, usually steel, seal rings. One or two elastomer o-rings serve to energize or urge the seal faces of the rigid ring or rings in contact with each other. The rigid face seal has proved to be as successful as the o-ring seal and provides an improved ability to accommodate pressure fluctuations in the bit lubricant.

A somewhat less successful design is the Belleville seal, in which elastomer elements are bonded to a rigid metallic ring or washer, which is placed under compression in the seal gland and the elastomer elements perform the bulk of the sealing.

Liquid drilling fluid is normally used for oil and gas well drilling, whereas compressed air is used as the drilling fluid in mining operations. Drilling fluid conveys cuttings to the surface and cools the bit. When the solid matter in drilling fluid is carried into the seal gland, it adheres to gland and/or seal component surfaces and causes deformation and/or slippage of elastomeric seal components. Moreover, these particles can accelerate abrasive wear of all seal components.

A need exists for seal assemblies that supplement the main bearing seal by assisting in the prevention of entry of debris into the seal assembly itself.

SUMMARY OF THE INVENTION

The exposure of cuttings to the mud of non-rotating parts is reduced. Only a small portion of the stationary ring of a metal face seal is exposed to the drilling fluid entering the seal gland. All of the other exposed components of the seal assembly are rotating with the cone.

A bit is provided having at least one leg extending downwardly and inwardly from the bit body. A cutter cone is rotatably mounted on a shaft extending inwardly from the lower portion of each leg. The annular space defined by the base of the shaft and the inner surface at the base of the cone forms a seal gland. An elastomeric o-ring sealingly engages an inner surface of the cone and a first rigid ring which rotates with the o-ring and cone. The o-ring energizes the first rigid ring for sealingly engaging a second rigid ring mounted to the leg of the bit near the base of the shaft. The second rigid ring is secured to and seals against a surface at the base of the shaft and is held stationary relative to the surface. A lubricant passage for lubricating the seal is pressurized by the drilling fluid pressure in the center of the bit body.

BRIEF DESCRIPTION OF THE DRAWINGS

The novel features believed to be characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DESCRIPTION OF THE INVENTION

Figure 1:
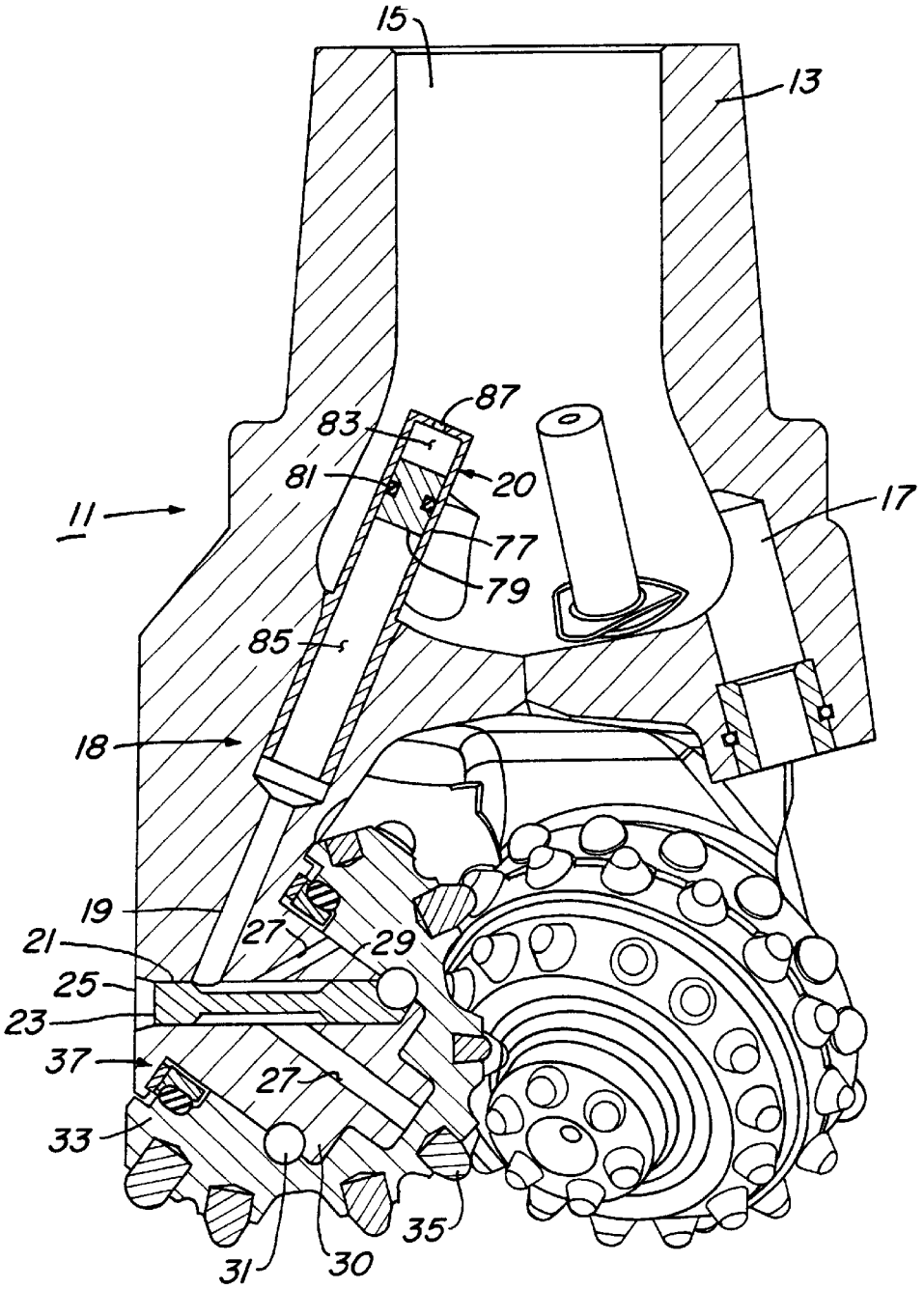
FIG. 1 is a longitudinal section view of the bit body of an earth-boring bit according to the present invention.

FIG. 1 shows an earth-boring bit 11 comprising a body having a threaded upper portion 13 for connection to a drill string member (not shown). A fluid passage 15 directs drilling fluid, normally air, to a nozzle 17 that impinges drilling fluid against the borehole bottom to flush cuttings to the surface of the earth.

A pressure-compensating lubrication system 18 is contained within each section of the body, there usually being three, which are welded together to form the composite body. In each section of the body, a lubricant passage 19 extends from each compensator 20 downwardly into intersection with another lubricant passage 21 in which a ball plug 23 is secured to the body by a plug weld 25. Lubricant passages 27 carry lubricant to a cylindrical journal bearing surface 29 machined into cutter 33 and a corresponding cylindrical surface on bearing shaft 30, which is cantilevered downwardly and inwardly from an outer and lower region of the body of the bit, commonly known as the shirttail.

Ball plug 23 retains a series of ball bearings 31 that rotatably secure cutter 33 to bearing shaft 30. Dispersed on the cutter are a plurality of rows of earth-disintegrating cutting elements or teeth 35 that may be constructed of a sintered tungsten carbide secured by interference fit into mating holes in cutter 33. A seal assembly 37 is disposed adjacent the base of bearing shaft 30 and seals lubricant within bearing 29 and debris out of bearing 29.

Figure 2:
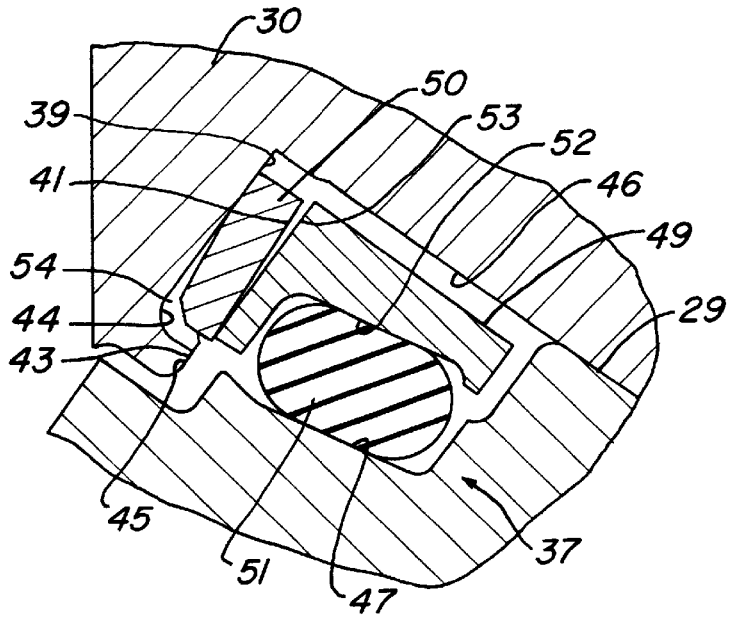
FIG. 2 is an enlarged section view of the seal assembly of FIG. 1.

FIG. 2 is an enlarged section view of one embodiment of a seal assembly of the earth-boring bit according to the present invention. Referring to FIG. 2, an cylindrical surface 39 is formed in last-machined surface 43 of the shirttail portion of the bit body by forming a recess 44 in surface 43. The outer radial edge of recess 44 defines a lip 45. Cylindrical surface 39 cooperates with a pair of radial surfaces 46, 47 to define a bearing seal gland generally at the base of bearing shaft 30. Surface 46 is on bearing shaft 30 and surface 47 is in cutter 33. Surface 46 is perpendicular to the axis of bearing shaft 30. Surface 47 is transverse but not perpendicular to the axis of bearing shaft 30.

A double-ring rigid or metal face seal 37 is disposed in the seal gland and includes rigid seal rings 49, 50 and an o-ring energizer 51, which sealingly engages surfaces 47 and 52 and urges a seal face 53 on ring 49 into sealing engagement with a corresponding seal face 41 on ring 50.

Recess 44 in surface 43 contains ring 50 and an elastomeric compound 54, which extends from lip 45 to approximately halfway between the outer diameter and inner diameter of ring 50, filling the annular space between the outer diameter of ring 50 and lip 45. Compound 54 seals ring 50 to the outer portion of recess 44 and holds ring 50 stationary relative to recess 44. A small portion of ring 50 extends above compound 54 for engaging ring 49.

O-ring 51 preferably has a durometer rating of approximately 60, providing a compressible energizer for seal assembly 37. Elastomeric compound 54 preferably has a much higher durometer rating of approximately 70, providing a very stiff sealing surface around and under ring 50. Compound 54 has a thickness of approximately 0.020" and does not increase the sealing force between faces 53 and 41. Flexure of ring 50 due to compression of compound 54 is negligible.

Referring again to FIG. 1, open-ended lubricant compensator 20 comprises a tubular body 77 and a piston 79 which travels within body 77. Piston 79 has an circumferential o-ring 81 for sealingly engaging the inner surface of body 20. Upper volume 83 is separated from lower volume 85 by piston 79 and o-ring 81. The upper end of body 77 has an opening 87 for communicating fluid passage 15 and upper volume 85. Lubricant is introduced into volume 85 and passages 19, 21, 27 during assembly of bit 11. Fluid pressure within passage 15 pressurizes volume 83 through opening 87 and causes piston 79 to exert a force on lubricant in lower volume 85. If lubricant leaks from seal assembly 37, lubricant travels from volume 85 and through passages 19, 21, 27 to replace the lost lubricant.

In operation, a drill string is attached to threaded portion 13 of bit 11. Bit 11 is lowered into a borehole, a fluid is pressurized in passage 15, and the drill string is rotated to rotate bit 11. As bit 11 rotates, teeth 35 on cone 33 engage rock or other material and rotate about shaft 30. Frictional force between surface 47 and o-ring 51 and between o-ring 51 and surface 52 causes o-ring 51 and seal ring 49 to rotate with cone 33. O-ring 51 energizes ring 49 into sealing engagement with seal ring 50, which is sealed to recess 44 by elastomeric compound 54, which also prevents ring 50 from rotating in recess 44. As debris begins to enter the seal gland, it is prevented from entering the bearing area by the sealing engagement of surface 47 to o-ring 51, o-ring 51 to surface 52, compound 54 to ring 50, and compound 54 to recess 44. Since only a small portion of ring 50 extends above compound 54, the amount of stationary surface of seal assembly 37 that is exposed to debris is minimized. The frictional force that can be exerted on ring 50 by cuttings packing is minimal, and almost all of the exposed portions of seal assembly 37 are already rotating with cone 33. The pressure in passage 15 pressurizes volume 83 of compensator 20, and, if lubricant leaks from seal assembly 37 or through other means, lubricant is forced into passages 19, 21, 27 for continuous lubrication of seal assembly 37.

Figure 3:
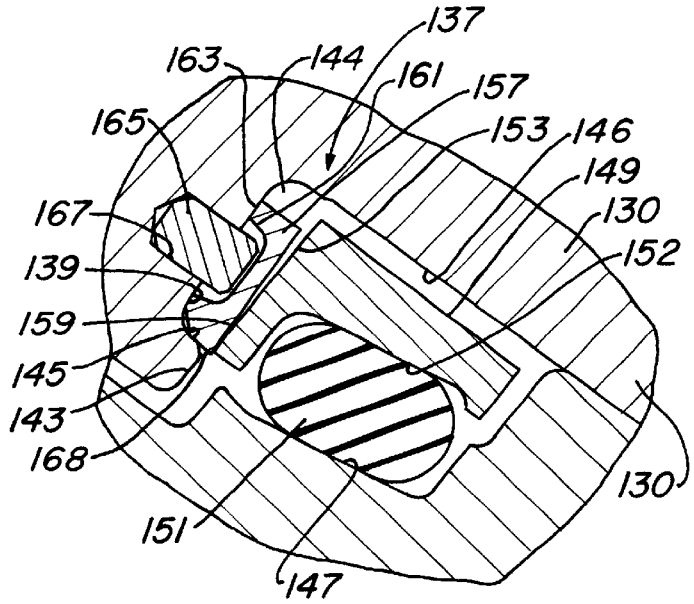
FIG. 3 is an enlarged section view of an alternative embodiment of the seal assembly of FIG. 1.

FIG. 3 shows a second embodiment of seal assembly 37 (FIG. 1) Seal assembly 137 includes an o-ring 151 which sealingly engages surfaces 147 and 152 and energizes ring 149, as described above, for sealingly engaging rigid ring 157. Ring 157 has a sealing face 159 for engaging sealing face 153 of ring 149. Ring 157 has a plurality of recesses 161 in th lower surface 163 of ring 157 for receiving a plurality of dowels 165. Dowels 165 are insert ed into holes 167 in cylindrical surface 139. Surface 163 of ring 157 is bonded to surface 139 and recesses 161 are bonded to dowels 165 for preventing rotation of ring 157 within recess 144. Outer surface 168 of ring 157 sealingly engages lip 145. Ring 157 extends slightly above surface 143 when installed in recess 144.

Figure 4:
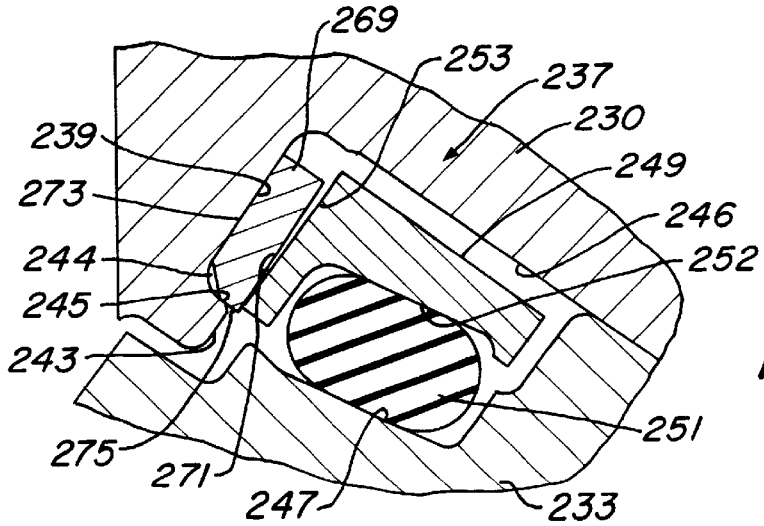
FIG. 4 is an enlarged section view of another alternative embodiment of the seal assembly of FIG. 1.

A third embodiment of seal assembly 37 (FIG. 1) is shown in FIG. 4. Seal assembly 237 includes a rigid ring 269 having a surface 271 that provides the counterface or sealingly engaging surface 253 of ring 249. The lower surface 273 of ring 269 is flat and continuous. Surface 273 is bonded to surface 239 of recess 244, and outer surface 275 sealingly en ages lip 245. When installed, ring 269 extends slightly above surface 243.

Figure 5:
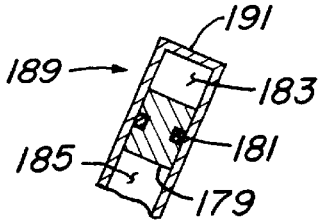
FIG. 5 is an enlarged view of an alternate embodiment of a lubrication compensator.

FIG. 5 shows the upper end of a second embodiment of a lubricant compensator. Compensator 189 has a body 191 having a closed upper end. A piston 179 is movably carried within body 191 and has an o-ring seal 181 for sealingly engaging the inner surface of body 191. Piston 179 and seal 181 divide the interior of body 191 into an upper volume 183 and lower volume 185. Lubricant is pumped into volume 185 to force piston 179 upward in body 191 As piston 179 is moved upward, the size of volume 183 decreases, and air contained in volume 183 by seal 181 is compressed. The compressed air causes a downward force on piston 179 for forcing lubricant in volume 185 to feed into passages 19, 21, 27 (FIG. 1) to continuously lubricate seal assembly 37.

One advantage of the present invention is to limit the effects of the packing of cuttings on the components of a seal assembly within a seal gland. Minimizing the exposure of non-rotating components to debris and rotating the exposed components reduces the effect of cuttings packing, which creates frictional force tending to rotate non-rotating components. Another advantage of the present invention is an improved lubricant compensator which pressurizes the lubricant for the bearings of the cones using the fluid pressure within the central passage in the bit or compressed air above a piston within a closed cylinder.

The invention has been described with reference to preferred embodiments thereof. It is thus not limited, but is susceptible to variation and modification without departing from the scope of the invention.

What is claimed is:

1. An earth-boring bit, comprising:

a bit body;

at least one bearing shaft depending inwardly and downwardly from the bit body, the bearing shaft having a base where it joins the bit body;

a cutter mounted for rotation on each bearing shaft;

a cavity located between the base and the cutter;

an annular recess formed in the base and surrounding the bearing shaft, the annular recess defining an annular lip on a radial outer margin of the base;

a substantially rigid first seal ring located in the cavity for rotation with the cutter;

a substantially rigid second seal ring secured in the recess and having a surface in dynamic sealing contact with the first seal ring; and a resilient energizer in substantially non-rotating contact with the first seal ring and in substantially non-rotating contact with a reacting inner surface of the cutter for urging the first seal ring against the second seal ring.

2. The earth-boring bit of claim 1, wherein:

a depth of the recess is greater than one half of a thickness of the second seal ring, the depth of the recess being defined as a height of the annular lip measured from a cylindrical surface of the recess, the thickness of the second seal ring being defined as a distance between the surface of the second seal ring in sealing contact with the first seal ring and an opposite, generally parallel surface of the second seal ring.

3. The earth-boring bit of claim 1, wherein:

the second seal ring is non-rotatably secured in the recess.

4. The earth-boring bit of claim 1, wherein:

the second seal ring is non-rotatably secured in the recess with an elastomeric material.

5. The earth-boring bit of claim 1, wherein:

the second seal ring is non-rotatably secured in the recess with at least one pin between the second seal ring and the base.

6. The earth-boring bit of claim 1, wherein:

there is substantially no gap between an outer edge of the second seal ring and a radial inner surface of the lip.

7. The earth-boring bit of claim 1, further comprising:

a central passage in the bit body leading to at least one nozzle for discharging a gaseous drilling fluid;

a lubricant passage leading from the bearing shaft to the central passage;

a sleeve located in the lubricant passage and protruding into the central passage; and a piston slidingly carried in the sleeve, separating lubricant in the sleeve from the gaseous drilling fluid in the central and for applying pressure of the drilling fluid to the lubricant.

8. The earth-boring bit of claim 1, further comprising:

a central passage in the bit body leading to at least one nozzle for discharging a gaseous drilling fluid;

a lubricant passage leading from the bearing shaft and having a closed end; and a piston slidingly carried in the lubricant passage, separating lubricant in the passage from a compressed gas chamber between the piston and the closed end for a positive pressure to the lubricant.

9. An earth-boring bit, comprising:

a bit body;

at least one bearing shaft depending inwardly and downwardly from the bit body, the bearing shaft having a base where it joins the bit body;

a cutter mounted for rotation on each bearing shaft;

a cavity located between the base and the cutter;

a substantially rigid first seal ring located in the cavity for rotation with the cutter;

a substantially rigid second seal ring having a surface in dynamic sealing contact with the first seal ring and being non-rotatably secured in an annular recess formed in the base and surrounding the bearing shaft, the annular recess defining an annular lip on a radial outer margin of the base, a height of the annular lip being sufficient to surround a substantial portion of an outer diameter of the second seal ring;

a resilient energizer in substantially non-rotating contact with the first seal ring and in substantially non-rotating contact with a reacting inner surface of the cutter for urging the first seal ring against the second seal ring; and wherein there is substantially no gap between an outer edge of the second seal ring and a radial inner surface of the lip.

10. The earth-boring bit of claim 9, wherein:

the height of the annular lip, as measured from a cylindrical surface of the recess, is greater than one half of a thickness of the second seal ring, the thickness being defined as a distance between the surface of the second seal ring in sealing contact with the first seal ring and an opposite and generally parallel surface of the second seal ring.

11. The earth-boring bit of claim 9, wherein:

the second seal ring is non-rotatably secured in the recess with an elastomeric material.

12. The earth-boring bit of claim 9, wherein:

the second seal ring is non-rotatably secured in the recess with at least one pin between the second seal ring and the base.

13. The earth-boring bit of claim 9, further comprising:

a central passage in the bit body leading to at least one nozzle for discharging a gaseous drilling fluid;

a lubricant passage leading from the bearing shaft to the central passage;

a sleeve located in the lubricant passage and protruding into the central passage; and a piston slidingly carried in the sleeve, separating lubricant in the sleeve from the gaseous drilling fluid in the central passage and for applying pressure of the drilling fluid to the lubricant.

14. The earth-boring bit of claim 9, further comprising:

a central passage in the bit body leading to at least one nozzle for discharging a gaseous drilling fluid;

a lubricant passage leading from the bearing shaft and having a closed end; and a piston slidingly carried in the lubricant passage, separating lubricant in the passage from a compressed gas chamber between the piston and the closed end for a positive pressure to the lubricant.

15. An earth-boring bit, comprising:

a bit body having a central fluid passage leading to at least one nozzle for discharging a gaseous drilling fluid;

at least one bearing shaft depending inwardly and downwardly from the bit body, the bearing shaft having a base where it joins the bit body;

a cutter mounted for rotation on each bearing shaft;

a cavity located between the base and the cutter;

a lubricant passage leading from the bearing shaft to the central fluid passage; and a sleeve located in the lubricant passage and protruding into the central fluid passage; and a piston slidingly carried in the lubricant passage.

16. The earth-boring bit of claim 15, wherein:

the sleeve has an open upper end.

17. The earth-boring bit of claim 15, wherein:

the sleeve has a closed upper end.

* * * * *

UNITED STATES PATENT AND TRADEMARK OFFICE

CERTIFICATE OF CORRECTION

PATENT NO. : 6,513,607 B2
DATED : February 4, 2003
INVENTOR(S) : Gregory W. Peterson et al.

It is certified that error appears in the above-identified patent and that said Letters Patent is hereby corrected as shown below:

Column 2,
Line 48, delete “an” before “cylindrical” and insert -- a --

Column 3,
Line 58, delete “th” and insert -- the --
Line 59, delete “insert ed” insert -- inserted --

Column 4,
Line 5, delete “en ages” and insert -- engages --

Column 5,
Line 21, after “central” insert -- passage --
Line 30, after “in the” insert -- lubricant --
Line 31, after “end for” insert -- applying --

Column 6,
Line 36, after “in the” insert -- lubricant --
Line 37, after “end for” insert -- applying --
Line 49, after “central fluid passage;” delete “and”

Signed and Sealed this

Sixth Day of May, 2003

JAMES E. ROGAN
*Director of the United States Patent and Trademark Office*